US005205703A

United States Patent [19]

Shill et al.

[11] Patent Number: 5,205,703

[45] Date of Patent: Apr. 27, 1993

[54] TOP SHEET HOLD DOWN FOR STACKED SHEET HANDLING MACHINE

[75] Inventors: David Shill, Spokane, Wash.; Curtis A. Roth, Post Falls, Id.

[73] Assignee: Thermoguard Equipment, Inc., Spokane, Wash.

[21] Appl. No.: 699,967

[22] Filed: May 14, 1991

[51] Int. Cl.[5] ..... B65G 59/02

[52] U.S. Cl. ..... 414/796; 414/796.8

[58] Field of Search ..... 414/796, 796.8, 797.2

[56] References Cited

U.S. PATENT DOCUMENTS

| | | | |
|---|---|---|---|
| 3,892,168 | 7/1975 | Grobman | 93/93 |
| 4,431,358 | 2/1984 | Jenkner | 414/796.8 X |
| 4,457,658 | 7/1984 | Meylan | 414/796.8 X |
| 4,700,941 | 10/1987 | Shill | 271/151 |
| 5,044,874 | 9/1991 | Shill | 414/796.8 X |

FOREIGN PATENT DOCUMENTS

| | | | |
|---|---|---|---|
| 3812756 | 6/1989 | Fed. Rep. of Germany | 414/797.2 |
| 749779 | 7/1980 | U.S.S.R. . | |

OTHER PUBLICATIONS

"The Jumbo Feedmaster," brochure of Thermoguard Equipment, Inc.

*Primary Examiner*—Michael S. Huppert
*Assistant Examiner*—Janice Krizek
*Attorney, Agent, or Firm*—Wells, St. John, Roberts, Gregory & Matkin

[57] ABSTRACT

A stacked sheet handling machine 11 includes a top sheet hold down apparatus 10 that prevents trailing sheets from following individual blocks of sheets separated from an upright stack supported on an elevator conveyor 15. A pusher plate 20 is moved laterally of a sheet stack 14 to engage a side 22 of the stack and push a sheet block 21 laterally from the stack and onto the discharge conveyor 17. A top sheet hold down is provided along the sheet block separator to securely hold the top sheet through provision of a hold down traction arrangement 38. Two forms of the hold down traction arrangement are disclosed, both being operated to move a friction surface against the top surface of the sheet 19 to hold the sheet stationary as the block is moved towards the discharge conveyor 17.

31 Claims, 8 Drawing Sheets

TOP SHEET HOLD DOWN FOR STACKED SHEET HANDLING MACHINE

TECHNICAL FIELD

The present invention relates to prevention of individual sheets trailing or moving horizontally with a block of sheets as the block of sheets is moved horizontally from a stack of sheets.

BACKGROUND OF THE INVENTION

In sheet handling industries, especially in the manufacture of corrugated paper cartons or boxes, large rectangular corrugated sheet blanks are stacked for storage and handling purposes. They are subsequently processed from the large upright stacks through various apparatus such as printers, die cutters, etc. according to customer requirements. Forming and printing type machinery often function at high speed. Thus, bulk quantities of stacked sheet material must be adequately fed to such machinery in order to maximize efficiency. The capacities of the handling apparatus are such that manual labor is not at all feasible. Automatic, mechanical machinery is therefore required to infeed the sheet material at adequate rates.

Stacks of sheet material are handled often in discrete quantities or "blocks" which are comprised of small numbers of the stacked sheets. Such "blocks" are more easily handled than large stacks.

Machinery has been developed to divide the large sheet material stacks into successive blocks for further handling. Block forming has been accomplished mechanically with only reasonable success.

A fairly typical problem accompanying the block formation process is that of "trailing sheets". Because of the many variations that can occur in production of the sheet material, as well as frictional and static electricity forces that can interfere with separation of a stack, sliding successive blocks of sheets from the top of a stack often results in a trailing sheet, usually the next top sheet of the stack, being dragged partially across the stack under the removed block. The protruding edges of the trailing sheet can subsequently jam the downstream machinery and thereby cause undesirable down time.

The present apparatus is intended to eliminate trailing sheets by keeping such sheets in position on the stack as successive blocks of sheets are removed therefrom.

The present apparatus resolves the trailing sheet problem by applying a friction surface against the next successive prescribed sheet under each successive block, and by frictionally holding the prescribed sheet in place as the above block is moved laterally of the stack. The prescribed sheet is held securely against "trailing" with the moving block as the block is engaged and moved horizontally from the stack.

BRIEF DESCRIPTION OF THE DRAWINGS

Preferred embodiments of the present invention are illustrated in the accompanying drawings, which are briefly described below.

FIG. 7 is a view similar to FIG. 6 only showing the pusher plate at its extended position across the stack and the resulting position of the block of sheets being pushed onto a discharge conveyor.

DETAILED DESCRIPTION OF THE PREFERRED EMBODIMENTS

Figure 1:
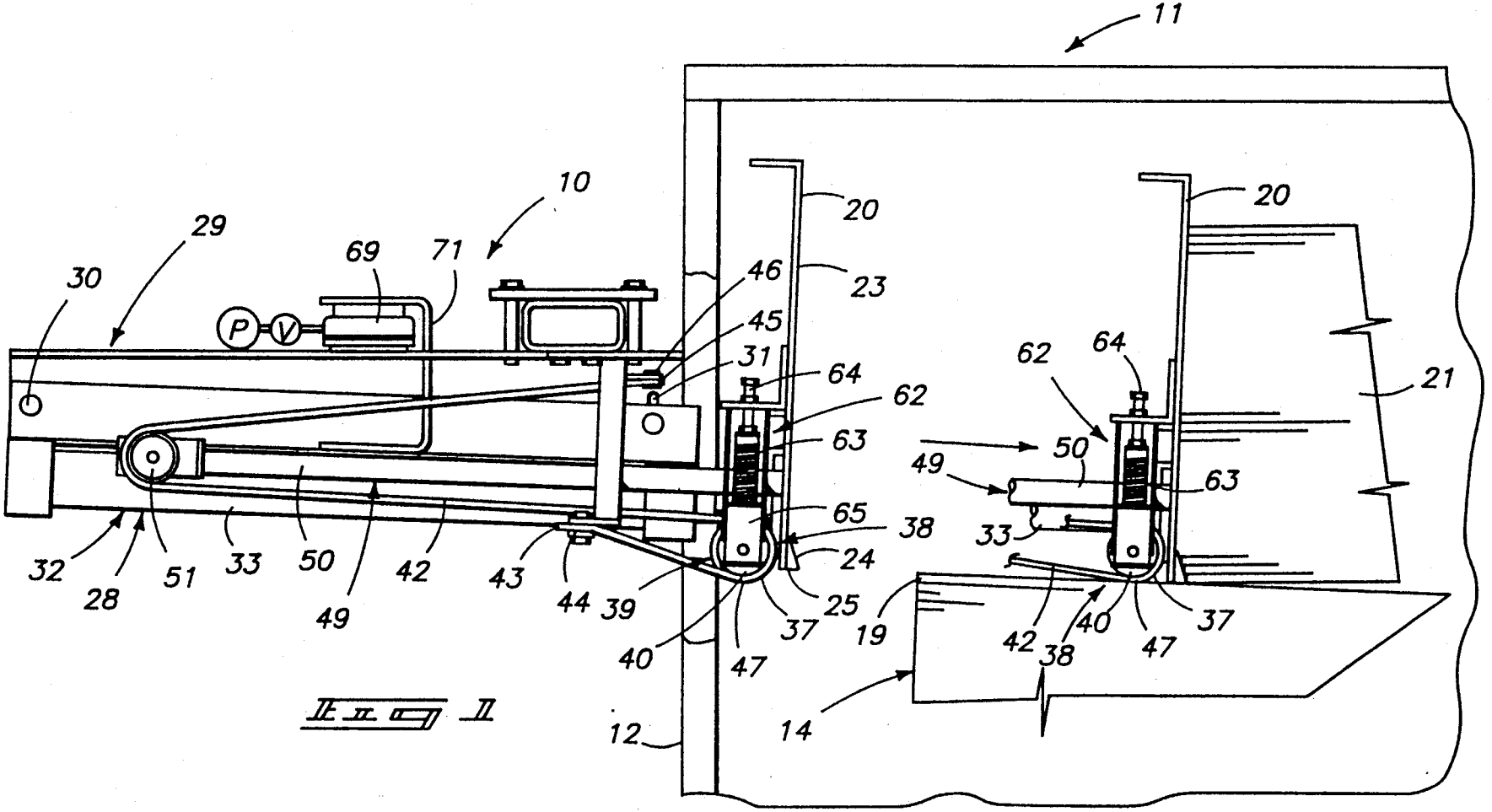
FIG. 1 is a fragmented side elevation view of a preferred top sheet hold down apparatus mounted to a sheet block pusher plate assembly, with the pusher plate shown in an inoperative view and a fragmented operative view.

This disclosure of the invention is submitted in furtherance of the constitutional purposes of the Patent Laws "to promote the progress of science and useful arts" (Article 1, Section 8).

The present stacked sheet handling machine is illustrated in the drawings and is generally designated therein by the reference numeral 11. The stacked sheet handling machine 11 includes a rigid framework 12. An infeed conveyor 13, if provided, may be situated to one side of the rigid frame 12 to receive (FIG. 3) and deliver a stack of sheets 14 onto an elevator conveyor 15 within the machine. Otherwise the stack 14 may be delivered directly to the elevator by manual means or mechanically, as by a fork lift truck (not shown).

Figure 2:
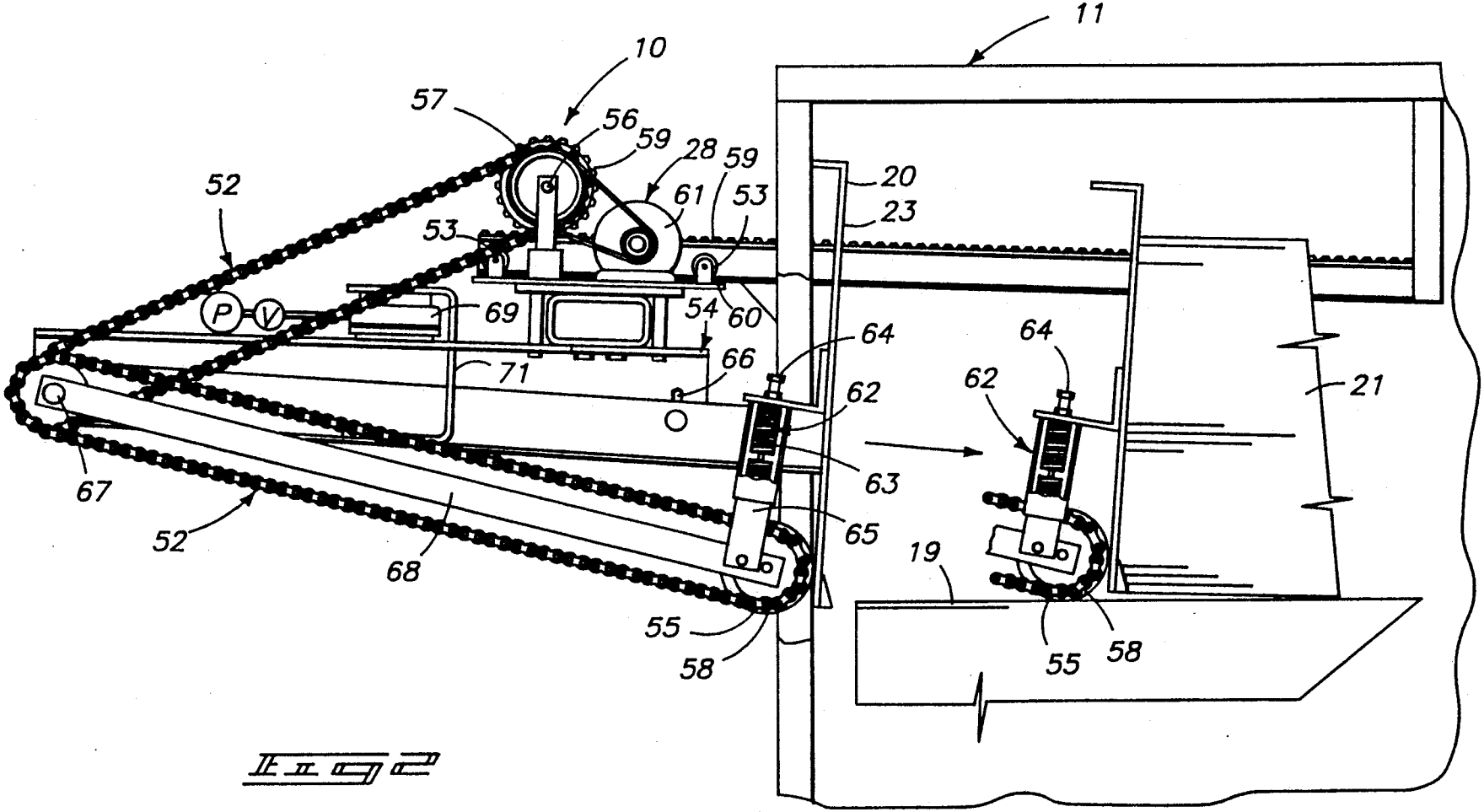
FIG. 2 is a fragmented elevational view of another preferred from of the present top trailing sheet hold down apparatus and pusher plate assembly, with the pusher plate shown in inoperative and fragmented operative views.

The elevator conveyor 15 includes a powered conveyor for receiving and moving the stacked sheets 14 from the infeed conveyor to a position against a back stop 16 (FIGS. 4–8). The elevator conveyor 15 is also powered to selectively hoist the sheet stack 14 vertically upward to position successive blocks of sheets 21 adjacent to the present sheet block separating apparatus 10 (FIGS. 1 and 2). The pusher plate 20 is operable by means of a driver 28 to selectively move successive blocks of sheets 21 substantially horizontally across the top surface of the sheet stack 14 to a discharge station adjacent a discharge conveyor 17.

It is noted that the discharge conveyor 17, the elevator conveyor, and the infeed conveyor 13 are shown in generic form, as different sheet material handling forms may be utilized along with features of the present invention. One example of another sheet block handling apparatus is disclosed in U.S. Pat. No. 4,700,941 granted to one of the present inventors on Oct. 20, 1987. Such information relating to the infeed, elevator, pusher plates and discharge mechanisms are hereby incorporated by reference into the present application.

The sheet stack is successively divided into individual blocks of sheets 21 by the sheet block separating apparatus 10, including the pusher plate 20 which engages one side 22 of the stack and pushes the engaged sheet block across the stack and up an inclined ramp 26 to the discharge conveyor 17. The block of sheets 21 leaving the stack exposes a prescribed subsequent top sheet 19 of the stack which then becomes the top sheet of the stack once the previous block of sheets 21 has been removed.

The pusher plate 20 is shown in detail in FIGS. 1 and 2. It includes a surface 23 facing the sheet stack for engaging successive blocks 21 of sheets and urging them across the top of the stack toward the discharge station and discharge conveyor 17. The surface 23 mounts a wedge 24 at a bottom plate edge 25.

The wedge 24 is utilized to assure that the bottom sheets of the block do not disengage themselves from the pusher plate. Instead, the rearwardly angled surface of the wedge applies a lifting force against the sheets as the plate is moved laterally, and thereby holds the sheets firmly during such motion. The pusher plate 20 is moved preferably at a slight downward angle (approximately 1 or 2 degrees) by the driver 28.

A horizontal pivot 30 is provided to facilitate slight elevational variation along the path of travel for the pusher plate 20. A rearward end of a pusher plate mounting framework 29 is pivoted at 30 to the machine framework 12. A forward end of the plate frame 29 is moveable about the pivot 30 within limits defined by a slot and pin arrangement 31.

The above pivot arrangement facilitates elevational movement of the driver and the attached pusher plate 20 to accommodate sheets having warped or bowed surfaces. The dimension of the slot 31 will also accommodate the elevational difference provided by the inclined path of the pusher plate 20 from the inoperative position adjacent the stacked sheet side 22 to an operative discharge position adjacent the discharge station and conveyor 17.

The preferred driver 28 includes a fluid operated cylinder 33 mounted to the pivoted section of the plate frame for pivotal motion about the axis of the pivot 30. The piston end of the driver cylinder is connected to the pusher plate 20. Extension and retraction of the cylinder will thus cause corresponding movement of the pusher plate across the stack from the inoperative position adjacent side 22 of the stack to the operative position laterally adjacent the discharge station and discharge conveyor.

A hold down traction means 38 is provided on the pusher plate 20 for movement with the pusher plate. The hold down traction means 38 includes a sheet engaging friction surface 37. The surface 37 is positionable in relation to the pusher plate in order to engage a top surface of the prescribed sheet 19 (immediately below an engaged block of sheets 21). The hold down traction means 38 includes a guide 39 which, in a first preferred form, is provided as a roller 40.

The sheet engaging friction surface 37 is provided along an outwardly facing surface of an elongated friction belt 42. First and second ends 43, 45 of belt 42 are secured to and are stationary on the machine frame 12. Clamps 44 and 46 respectively are mounted to the framework for this purpose.

The length of the belt 42 between the fastened ends 43, 45 is selected to enable travel of the pusher plate from its initial inoperative starting position adjacent the stack side 22 to an operative position adjacent the discharge station 17. To accommodate this expanse of belt 42, a take up means 49 is provided.

Take up means 49 includes a bar 50 mounted to and extending rearwardly from the pusher plate 20. The rearward end of the bar 50 mounts a take up roller 51.

Figure 4:
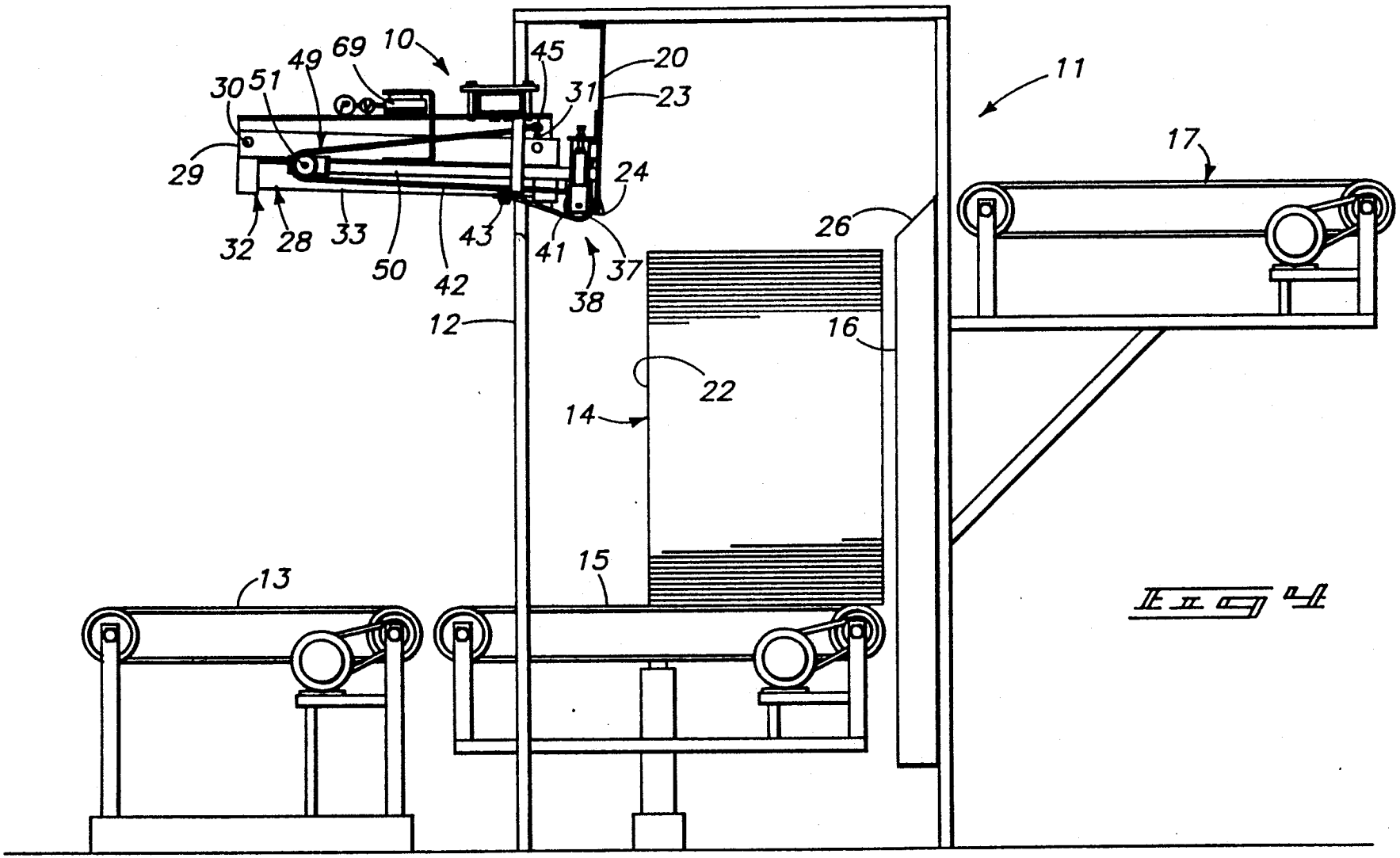
FIG. 4 is a view similar to FIG. 3 only showing the sheet stack in position on an elevator conveyor.
Figure 5:
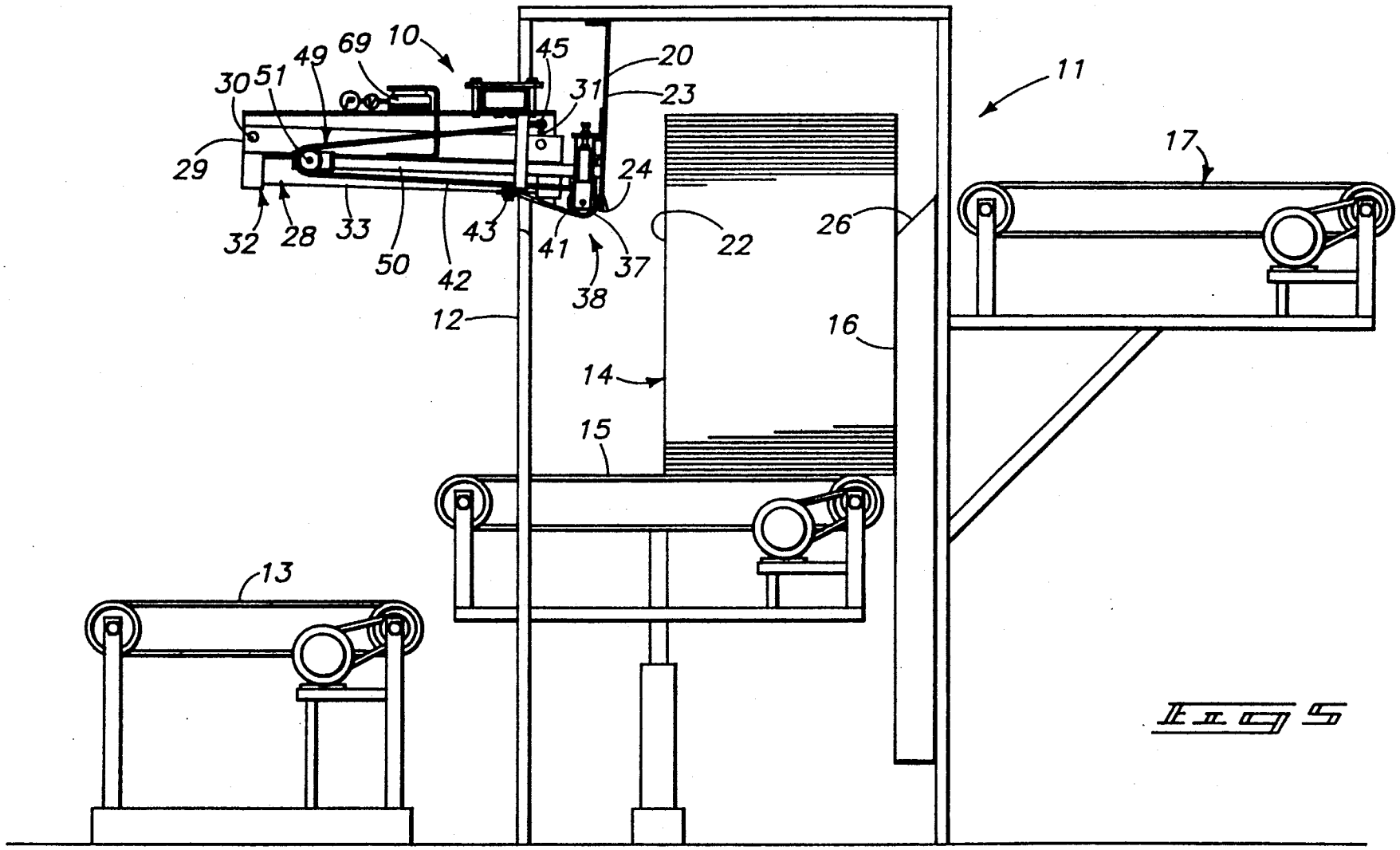
FIG. 5 is a view similar to FIG. 4 only showing the stack elevated to position a block of sheets adjacent a pusher plate for removal from the stack.
Figure 6:
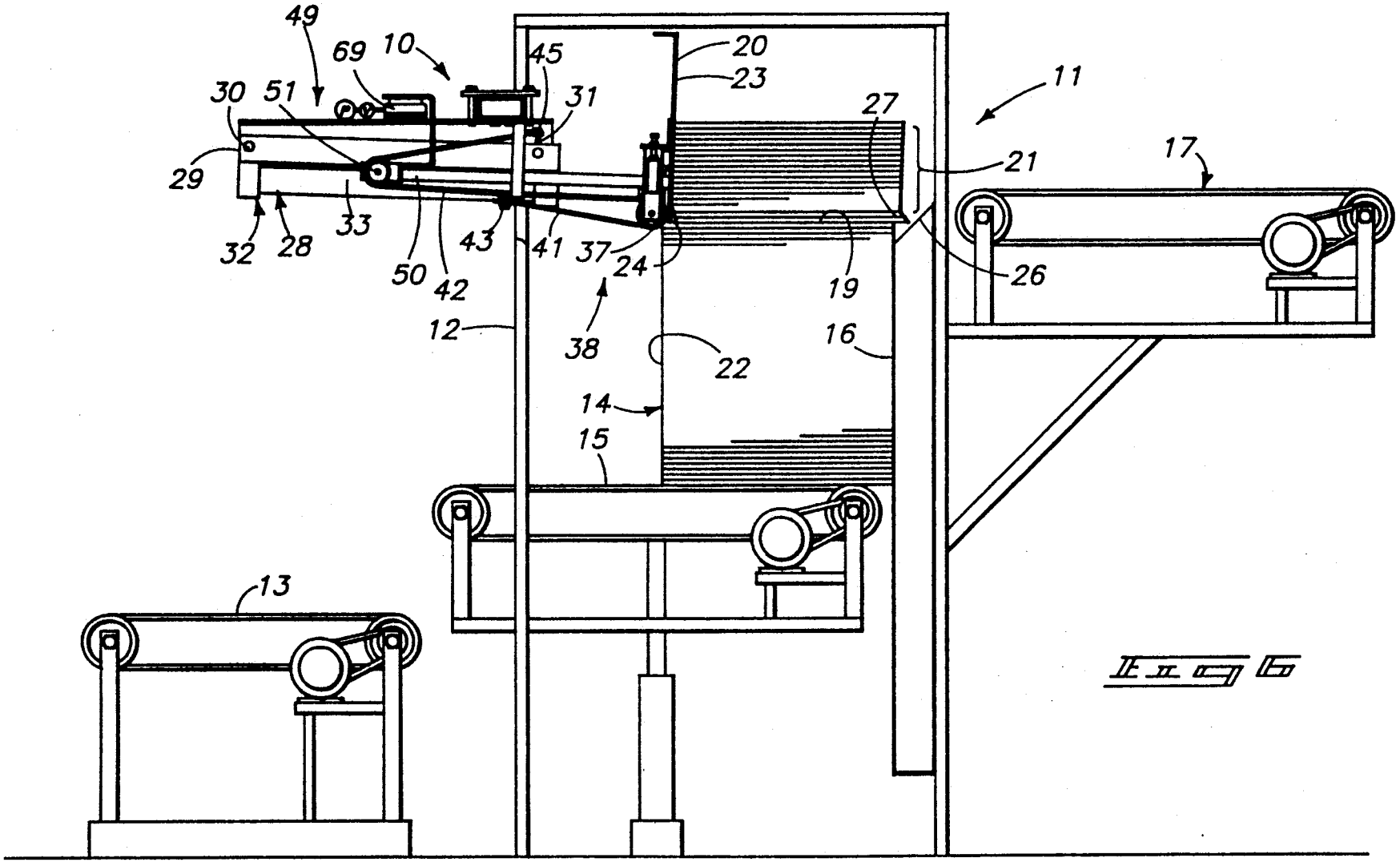
FIG. 6 is a view similar to FIG. 5 only showing a block of sheets initially being moved by the pusher plate.
Figure 11:
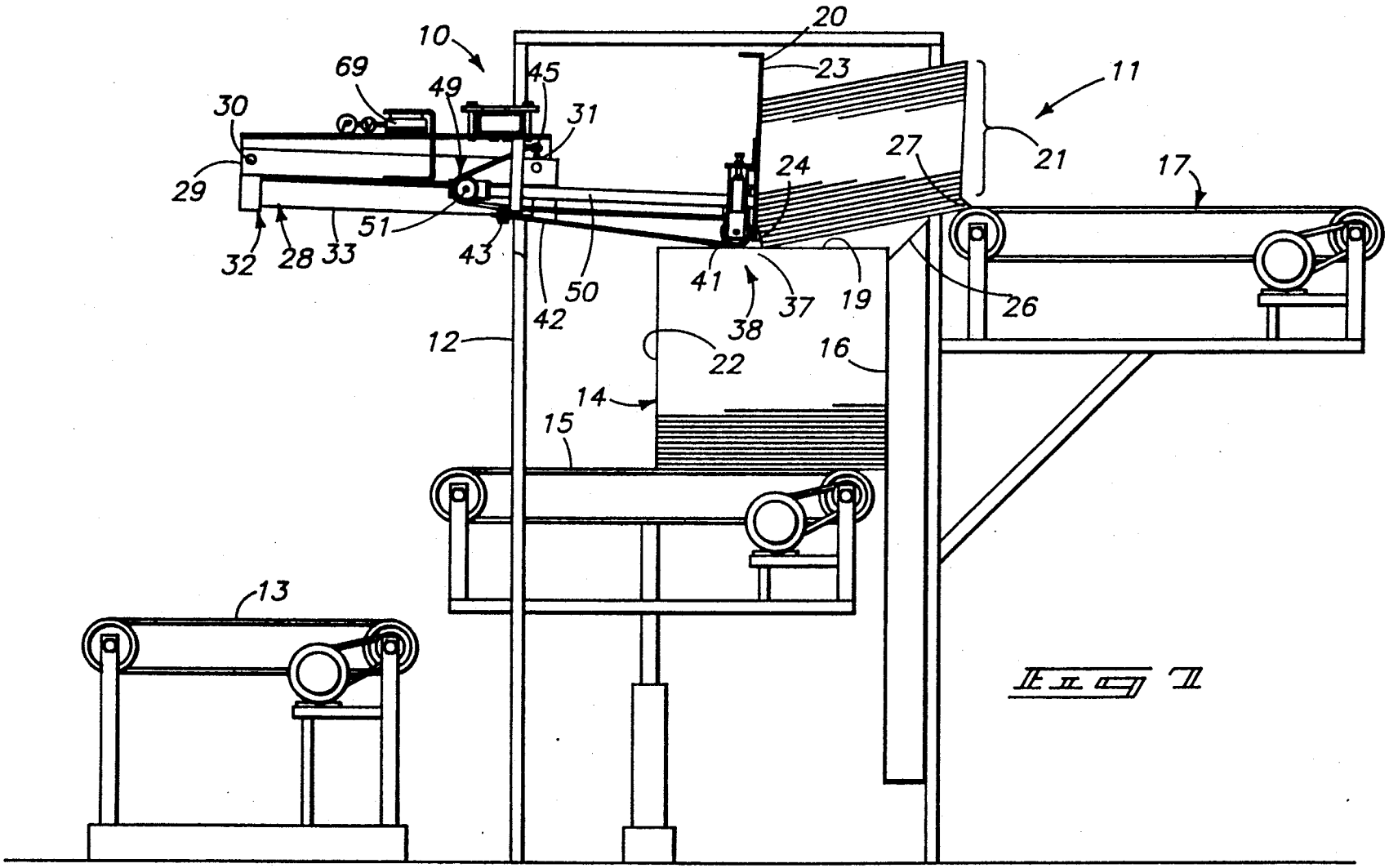

The friction belt 42 is trained from the stationary first end, around the guide roller 40, and back around the take up roller 51 to the stationary second clamp 46. The belt 42 is extended across the prescribed sheet 19 between the guide roller and take up roller 51 as the pusher plate moves to the operative position (FIG. 6). Conversely, the belt 42 is taken up between the roller 51 and the stationary first end as the pusher plate is moved back from the operative position to the inoperative position adjacent the stack (FIG. 4).

The above described belt motion is responsive to motion of the pusher plate. The driver 28 (cylinder 33) therefore effectively functions as driver link means 32 for operating the traction means (belt 42) to move its sheet engaging friction surface in a direction opposite to that of the pusher plate in order to hold the prescribed sheet 19 stationary relative to movement of the block of sheets being moved.

Any tendency for the prescribed top sheet 19 to move or "trail" in the direction of the pusher plate 20 is countered by the belt 42 because the friction surface 47 thereof is held firmly against the top sheet surface. The friction surface 47 will stay stationary relative to the prescribed sheet 19, yet movable relative to the pusher plate 20, to remain in engagement with the sheet 19 as the plate moves back and forwardly.

Another preferred embodiment of the present sheet hold down apparatus is illustrated in FIG. 2. The plate frame 54 in this embodiment is mounted to a laterally movable carriage 60. The carriage 60 is movably mounted to the frame 12 by appropriate wheels 53. A drive motor 61 is mounted to the carriage and is connected by a sprocket assembly 57 to the machine frame.

The sprocket assembly 57 functions as a driver link means 52, including a series of chains and sprockets pivotably connecting, as a linkage means the friction wheel 55 and the machine frame 12. The linkage provides positive drive to the friction wheel 55 at a rotational rate substantially equal to forward progress of the pusher plate.

Here, at least one friction wheel 55 is provided on a movable pusher plate frame 54 and is rotated through a driver link means 52 connected to the pusher plate driver motor 61 and a driver shaft 56. The shaft 56 rotates through a linkage means, including a sprocket assembly 57 attached to the shaft 56.

The linkage also includes an arm 68 mounted to the plate frame 54 which enables the wheel 55 to pivot up and downwardly. Such motion is provided supplementary to a pusher plate frame pivot and slot arrangement 66 that is similar to the pivoted plate frame 29 and slot 31 arrangement described above.

More specifically, the motor 61 is drivingly connected to shaft 56, which also mounts the sprocket assembly 57, and the pinion of a rack and pinion arrangement 59. Drive motor 61, when selectively operated, will rotate the pinion, which will then move the entire pusher plate frame 54 along the rack. The pusher plate assembly will thus move in a path from the inoperative position adjacent the one side 22 of the stack, to the operative position shown to the right of the inoperative position in FIG. 2.

The rack of the rack and pinion assembly 59 is secured to the machine stationary frame. The rack may be tilted at an angle of approximately 1 or 2 degrees downwardly to lead the pusher plate assembly slightly downward as it moves across the stack.

During this time, the shaft 56 will rotate the friction wheel 55 through the driver link means, engaging the friction surface 58 against the prescribed top sheet 19 of the stack, and holding it in place as the engaged block of sheets is moved from the stack toward the discharge conveyor 17.

Both preferred forms of the pusher arrangement described above include a hold down pressure means generally shown at 62. The hold down pressure means 62 is provided to yieldably control downward force of the hold down traction means against the prescribed sheet 19 immediately below the block of sheets being removed from the stack.

In a first form (FIG. 1), the hold down pressure means 62 is comprised of an adjustable compression spring 63 mounted to the pusher plate and connected to the guide roller 40 in one preferred form, and the wheel 55 in the other preferred form. The roller 40 and wheel 55 are mounted to their respective compression springs 63 by way of adjustment bolts 64 and roller (and wheel) mounting yokes 65.

The guide roller 40 and wheel 55 are thereby movably mounted to their respective pusher plates for elevational movement as yieldably controlled through the compression spring 63 and adjustment bolts 64. Rotation of the bolts will selectively adjust the downward pressure applied against the prescribed sheet 19 when the pusher plate is in operation.

It should be noted that the downward pressure is applied from the pusher plate. Thus, an equal and opposite upward force is applied to the pusher plate. Thus the hold down pressure means 62 is useful to selectively control the downward weight or pressure applied by the pusher plate bottom edge to the prescribed sheet 19.

In fact, it is desirable to maintain the bottom edge just slightly above the prescribed sheet so there is no tendency for the wedge 24 to engage and slide the prescribed sheet toward the discharge station.

The compression springs may be supplemented or replaced entirely by a second preferred form of hold down pressure means in the form of an air bladder arrangement 69. FIGS. 1 and 2 show air bladders 69 mounted on the plate frames 29, 54. Brackets 71 are mounted to top sides of the air bladders and extend downwardly to the pivoted portion of the pusher plate frames.

Selective inflation or deflation of the air bladders will therefore result in pivotal motion of the pivoted portion of the plate frames about the pivot points 30, 67. The air bladders 69 therefore will selectively control the overall downward pressure applied by the entire pusher plate assembly suspended from the pivot points 30, 67 against the stack of sheets 14.

It should be noted that the sheet block separating apparatus, including the pusher plate assembly, the hold down traction means, and the hold down pressure means may be supplied either as an integral part of a novel stacked sheet handling machine as described, or as a retrofit sheet block separating apparatus, to be mounted to existing stacked sheet handling machines. Additionally, retrofits including the traction means, the hold down pressure means, and driver link means may be supplied as top sheet hold down apparatus in machines already having pusher plates similar to those described above. Such applications fall within the scope of this disclosure and, with the teachings herein will readily become apparent to those of skill in the art of the present invention.

Figure 3:
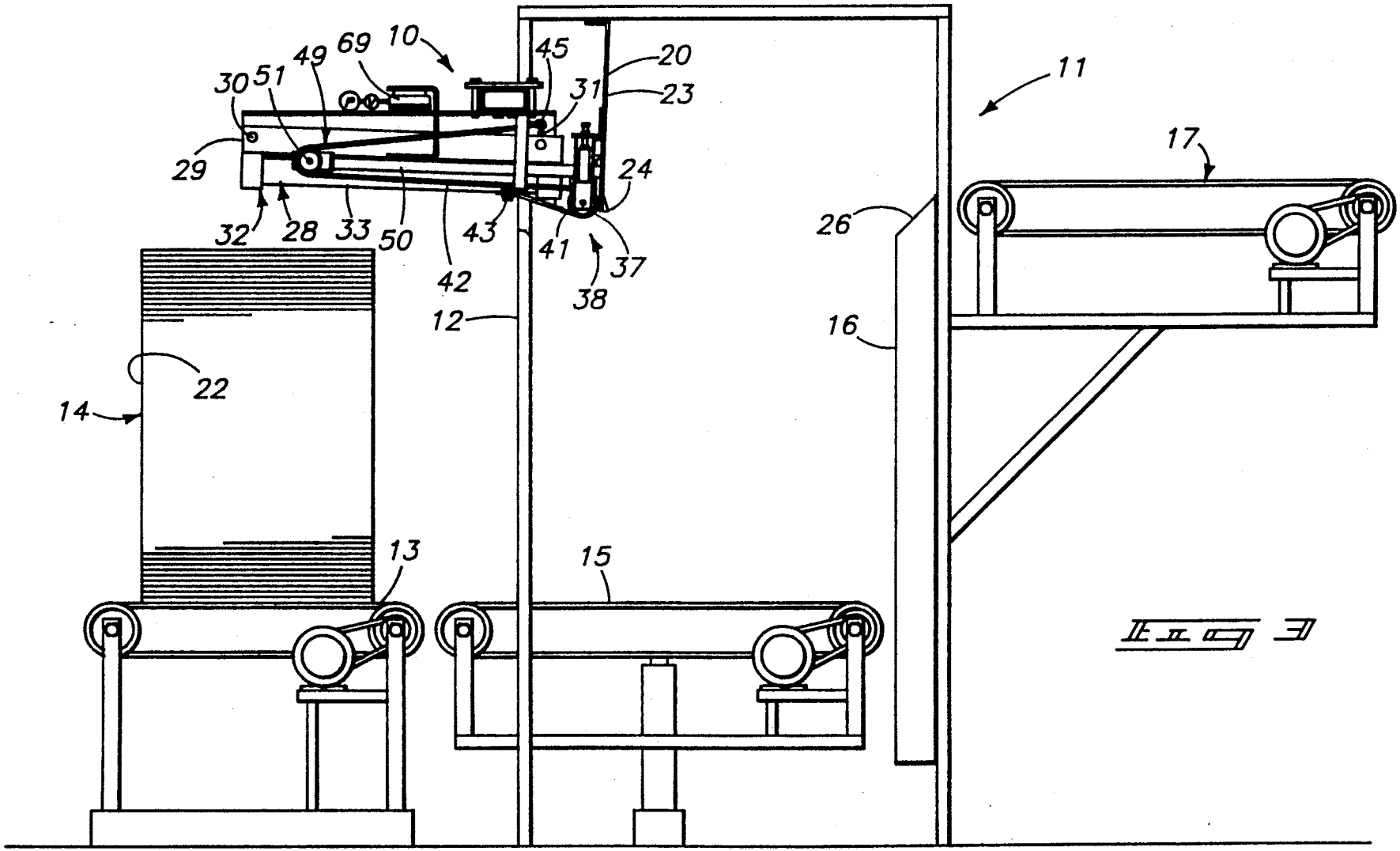
FIG. 3 is a view of the stacked sheet handling machine receiving a stack of sheets on an infeed conveyor.

In operation a stack of sheets 11 is initially placed on the infeed conveyor 13 (FIG. 3). The conveyor is then operated to move the stack onto the elevator conveyor 15 (FIG. 4). The conveyor portion of the elevator conveyor 15 then operates to move the stack laterally into abutment with the backstop 16.

At this point, the elevator portion of the elevator conveyor 15 operates to lift the stack (FIG. 5) by a distance sufficient to bring a selected block of sheets 21 into lateral alignment with the pusher plate 20. Appropriate sensors (not shown) detect the presence of the sheet block and actuate the pusher driver to shift the pusher plate 20 laterally against the side 22 of the stack, or, more particularly, against the side 22 of the block 21 to be removed.

As the pusher plate moves laterally, the wedge 24 first engages the stack and shifts the bottom sheets of the block laterally toward the discharge station and the ramp 26. The bottom sheets of the block ride against the inclined surface of wedge 24 and, due to lateral resistance, tend to slide upwardly. Thus the wedge functions to hold the engaged sheets against dropping below the pusher plate. The initial engaged position of the pusher plate and the resulting formation of the sheet block 21 is shown in FIG. 6.

FIG. 6 illustrates the initial position of the hold down traction means 38 as it initially engages the side 22 of the stack. It is noted that the traction surface is situated just slightly below the top surface of the prescribed sheet 19 in the stack. Thus, the traction surface must initially "climb" up onto the surface 19. This is made possible by the driving forces applied through the driver link means, transmitting the forward motion of the pusher plate through the elongated friction belt 42. A guide roller 40 will deflect upwardly through provision of the compression spring hold down and exert a constant downward force on the prescribed sheet 19 as the pusher plate moves across the stack to the discharge position. The pusher plate shown in FIG. 7 is approaching the discharge position in which the stack has initially engaged the ramp 26, has moved up the ramp, and has engaged the discharge conveyor 17. All this time, the friction surface 47 of the elongated friction belt 42 is engaged to securely hold the prescribed top sheet 19 against lateral movement with the engaged, moving block of sheets 21.

Figure 8:
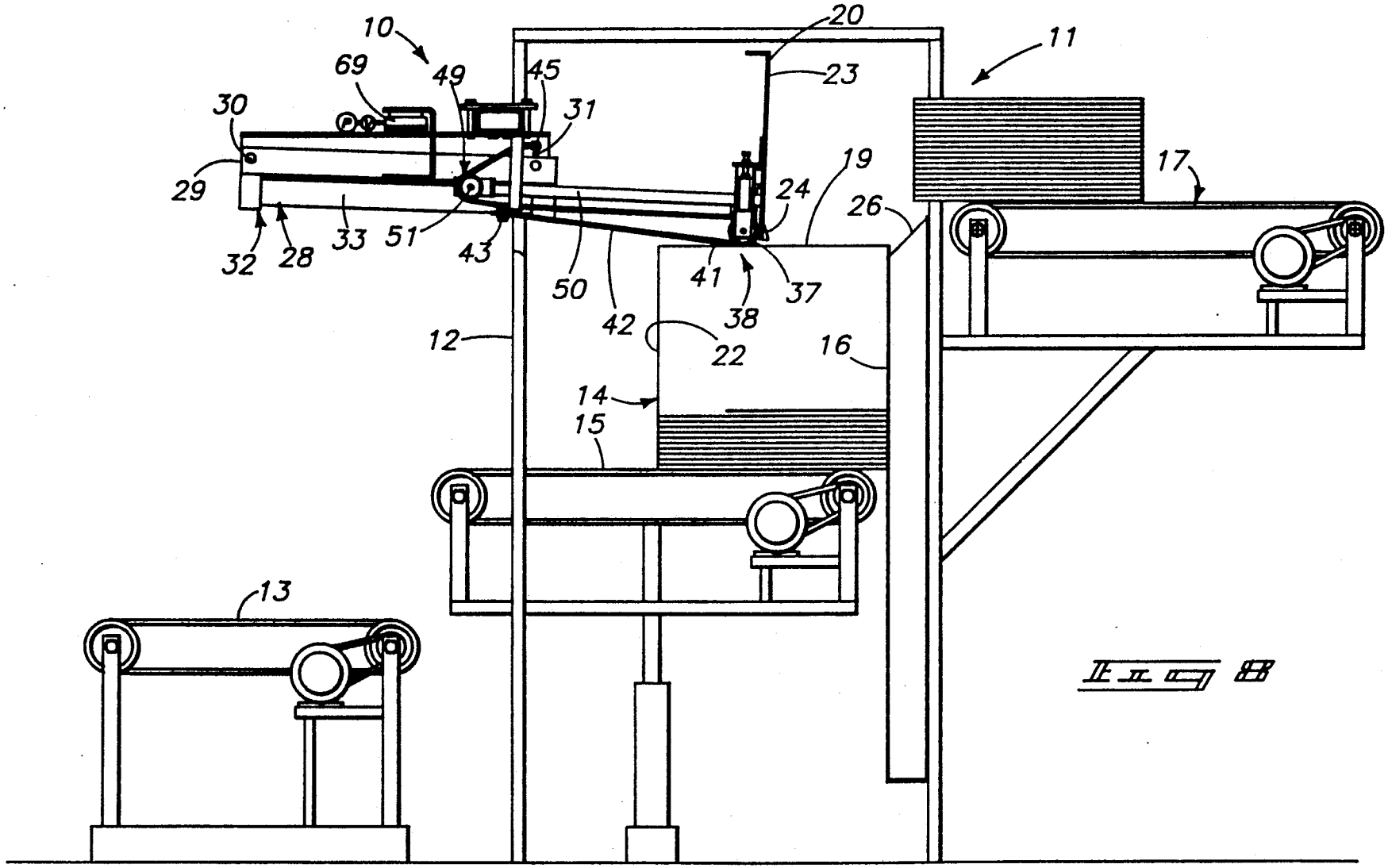
FIG. 8 is a view similar to FIG. 7 only showing the block of sheets on the discharge conveyor.

FIG. 8 illustrates the pusher plate being retracted and the previously engaged block of sheets initially moving along the discharge conveyor 17. As the pusher plate is retracted, the moving plate operates, through the drive link means, to move the belt 42 in an opposite direction, thereby holding the top prescribed sheet 19 firmly in a stationary position as the pusher plate is retracted to its initial inoperative position.

It may be desirable during initial operation to adjust the downward pressure and position of the hold down means in relation to the pusher plate and prescribed top sheet 19. This may be done by adjusting the bolt 64, thereby adjusting the compression spring against the roller 40 and, consequently, similarly adjusting the upward forces against the pusher plate 20. Additional adjustments may be made by inflating or deflating the air bladder 70 to effect an overall change of the total weight distributed at the pusher plate end of the assembly.

Operation of the FIG. 2 preferred form of the invention is very similar to that described above, with the exception that the wheel 55 is driven through the chain and sprocket arrangements to apply the holding forces against the top prescribed sheet 19. The wheel is rotated at the same rate to present the friction surface against the top sheet as the pusher plate is moved across the stack.

The above-described apparatus functions reliably to facilitate separation of successive blocks of sheets from a stack and to firmly yet safely hold the prescribed top sheet of the remaining portion of the stack in position to eliminate the "trailing sheet" problem previously experienced with many forms of sheet block handling apparatus.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

We claim:

1. A top sheet hold down apparatus for use with a stacked sheet handling machine which progressively removes successive blocks of sheets from the top of an upright stack of sheets by a sheet block pusher plate moved by a driver substantially horizontally to engage a block of sheets along one side surface of the block and to move the engaged block of sheets substantially horizontally across the sheet stack to a discharge station at an opposite side of the stack, said top sheet hold down apparatus comprising:

a hold down traction means mounted for movement with the pusher plate, said hold down traction means including a sheet engaging friction surface which engages a top surface of a prescribed sheet in the stack immediately below a block of sheets engaged by the pusher plate;

driver link means for driving the sheet engaging friction surface independently of contact with the top surface of the prescribed sheet in a direction opposite to that in which the pusher plate is moved to hold the prescribed sheet stationary relative to the stack of sheets.

2. The apparatus as claimed by claim 1 wherein the hold down traction means is moved at a downward angle toward the stack as the pusher plate is moved to push a block of sheets across the stack.

3. The apparatus as claimed by claim 1 further comprising hold down pressure means between the hold down traction means and the pusher plate for yieldably controlling downward forces exerted by the hold down traction means against the prescribed sheet.

4. The apparatus as claimed by claim 1 wherein the driver link means is operably connected to the driver of the stacked sheet handling machine to operate the traction means to move the sheet engaging friction surface in a direction opposite that of the pusher plate in response to movement of the pusher plate to the discharge station.

5. The apparatus as claimed by claim 1 further comprising hold down pressure means in the form of an adjustable compression spring mounted between the hold down traction means and the pusher plate for yieldably controlling downward force exerted by the hold down traction means against the prescribed sheet.

6. The apparatus as claimed by claim 1 further comprising hold down pressure means in the form of a selectively inflatable air bladder mounted between the pusher plate and the stacked sheet handling machine for selectively controlling downward pressure of the hold down traction means against the prescribed sheet.

7. The apparatus as claimed by claim 1 wherein the hold down traction means is comprised of:

a guide on the pusher plate adjacent a bottom surface thereof;

an elongated friction belt having first and second ends attached to the stacked sheet handling machine, and a length dimension between the first and second ends;

wherein the elongated friction belt is trained along its length over the guide on the pusher plate; and take up means for maintaining the belt taut along its length as the pusher plate is moved across the stack of sheets.

8. The apparatus as claimed by claim 1 wherein the hold down traction means is comprised of:

a guide roller on the pusher plate adjacent a bottom surface thereof;

an elongated friction belt having first and second ends attached to the stacked sheet handling machine, and a length dimension between the first and second ends;

and wherein the elongated friction belt is trained along its length over the guide roller on the pusher plate; and take up means comprised of a take up roller mounted to the pusher plate and engaging the belt for maintaining the belt taut along its length as the pusher plate is moved across the stack of sheets.

9. The apparatus as claimed by claim 1 wherein the hold down traction means is comprised of a wheel rotatably mounted to the pusher plate and wherein the sheet engaging friction surface is situated on the wheel perimeter to tangentially engage the prescribed sheet in the stack immediately below a block of sheets engaged by the pusher plate; and wherein the driver link means is comprised of a linkage means connecting the wheel and the stacked sheet handling machine for rotating the wheel responsive to motion of the pusher plate.

10. The apparatus as claimed by claim 1 further comprising a guide on the pusher plate adjacent a bottom surface thereof;

wherein the hold down traction means is comprised of an elongated friction belt having first and second ends attached to the stacked sheet handling machine, and a length dimension between the first and second ends;

wherein the elongated friction belt is trained along its length over the guide on the pusher plate;

hold down pressure means between the guide and the pusher plate for yieldably controlling downward pressure exerted by the hold down traction means against the prescribed sheet; and take up means engaging the belt for maintaining the belt taut along its length as the pusher plate is moved across the stack of sheets.

11. The apparatus as claimed by claim 1 further comprising a guide on the pusher plate adjacent a bottom surface thereof;

wherein the hold down traction means is comprised of an elongated friction belt having first and second ends attached to the stacked sheet handling machine, and a length dimension between the first and second ends;

wherein the elongated friction belt is trained along its length over the guide on the pusher plate;

hold down pressure means in the form of an adjustable compression spring mounted between the hold down traction means and the pusher plate for controlling downward exertion of force by the hold down traction means against the prescribed sheet; and take up means engaging the belt for maintaining the belt taut along its length as the pusher plate is moved across the stack of sheets.

12. The apparatus as claimed by claim 1 wherein the hold down traction means is comprised of:

a guide on the pusher plate adjacent a bottom surface thereof;

an elongated friction belt having first and second ends attached to the stacked sheet handling machine, and a length dimension between the first and second ends;

wherein the elongated friction belt is trained along its length over the guide on the pusher plate;

take up means for maintaining the belt taut along its length as the pusher plate is moved across the stack of sheets;

and further comprising hold down pressure means in the form of a selectively inflatable air bladder mounted between the pusher plate and the stacked sheet handling machine for controlling downward pressure applied by the hold down traction means against the prescribed sheet.

13. The apparatus as claimed by claim 1 wherein the hold down traction means is comprised of a wheel rotatably mounted to the pusher plate and wherein the sheet engaging friction surface is situated on the wheel perimeter to tangentially engage the prescribed sheet in the stack immediately below a block of sheets engaged by the pusher plate;

wherein the driver link means is comprised of a linkage means connecting the wheel and the stacked sheet material handling machine for rotating the wheel against the stack immediately below a block of sheets engaged by the pusher plate responsive to motion of the pusher plate; and further comprising hold down pressure means between the hold down traction means and the pushed plate for adjustably controlling downward pressure of the hold down traction means against the prescribed sheet.

14. The apparatus as claimed by claim 1 wherein the hold down traction means is comprised of a wheel rotatably mounted to the pusher plate and wherein the sheet engaging friction surface is situated on the wheel perimeter to tangentially engage the prescribed sheet in the stack immediately below a block of sheets engaged by the pusher plate; and wherein the driver link means is comprised of a linkage means connecting the wheel and the stacked sheet handling machine for rotating the wheel against the stack below the block of sheets engaged by the pusher plate, in response to motion of the pusher plate toward the discharge station; and further comprising hold down pressure means in the form of an adjustable compression spring mounted between the hold down traction means and the pusher plate for adjustably controlling downward forces applied by the hold down traction means against the prescribed sheet.

15. The apparatus as claimed by claim 1 wherein the hold down traction means is comprised of a wheel rotatably mounted to the pusher plate and wherein the sheet engaging friction surface is situated on the wheel perimeter to tangentially engage the prescribed sheet in the stack immediately below a block of sheets engaged by the pusher plate;

wherein the driver link means is comprised of a linkage means connecting the wheel and the stacked sheet handling machine for rotation the wheel against the stack below the pusher plate responsive to motion of the pusher plate; and further comprising hold down pressure means in the form of a selectively inflatable air bladder mounted between the pusher plate and the stacked sheet handling machine for selectively controlling downward pressure applied by the hold down traction means against the prescribed sheet.

16. The apparatus as claimed in claim 1 further comprising hold down pressure means between the hold down traction means and the pusher plate for controlling an applied downward force by the hold down traction means against the prescribed sheet; and further comprising a wedge member mountable on the pusher plate at a bottom edge thereof and projecting therefrom toward the stack of sheets.

17. An apparatus as claimed in claim 1 wherein the hold down traction means is comprised of:

a guide on the pusher plate adjacent a bottom surface thereof;

an elongated friction belt having a length dimension between first and second ends and being attached to the stacked sheet handling machine;

wherein the elongated friction belt is trained along its length over the guide on the pusher plate; and take up means for maintaining the belt taut along its length as the pusher plate is moved across the stack of sheets.

18. A sheet block separating apparatus for use with a stacked sheet handling machine which progressively removes successive blocks of sheets from a stack having opposed stack surfaces to a block discharge station for removal therefrom, said sheet block separating apparatus comprising:

sheet block pusher plate moveable substantially horizontally to engage a block of sheets along one side surface of the block and to move the engaged block of sheets substantially horizontally across the sheet stack toward an opposite side of the stack;

hold down traction means mounted for movement with the pusher plate said hold down traction means including a sheet engaging friction surface which engages a top surface of a prescribed sheet in the stack immediately below a block of sheets engaged by the pusher plate;

driver link means for driving the sheet engaging friction surface independently of contact with the top surface of the prescribed sheet in a direction opposite to that in which the pusher plate is moved to hold the prescribed sheet stationary relative to the stack of sheets.

19. A sheet block separating apparatus as claimed by claim 18, wherein the pusher plate is movable at a downward angle from a retracted inoperative position at one side surface of the stack across the stack toward an opposite side thereto.

20. A sheet block separating apparatus as claimed by claim 18, further comprising hold down pressure means between the hold down traction means and the pusher plate for controlling the hold down traction means to exert a selected downward pressure against the prescribed sheet.

21. A sheet block separating apparatus as claimed by claim 18 further comprising hold down pressure means in the form of an adjustable compression spring mounted between the hold down traction means and the pusher plate for controlling the hold down traction means to exert a downward pressure against the prescribed sheet.

22. A sheet block separating apparatus as claimed by claim 18 further comprising hold down pressure means in the form of a selectively inflatable air bladder mounted between the pusher plate and the stacked sheet handling machine for selectively controlling downward pressure of the hold down traction means against the prescribed sheet.

23. A sheet block separating apparatus as claimed by claim 18 further comprising:

hold down pressure means including an adjustable compression spring mounted between the hold down traction means and the pusher plate for yieldably biasing the hold down traction means downwardly against the prescribed sheet; and a selectively inflatable air bladder mounted between the pusher plate and the stacked sheet handling machine for selectively controlling downward pressure of the pusher plate and hold down traction means against the prescribed sheet.

24. An apparatus as claimed by claim 18 wherein the hold down traction means is comprised of:

a guide roller on the pusher plate adjacent a bottom surface thereof;

an elongated friction belt having first and second ends attached to the stacked sheet handling machine, and a length dimension between the first and second ends;

and wherein the elongated friction belt is trained along its length over the guide roller on the pusher plate; and take up means comprised of a take up roller mounted to the pusher plate and engaging the belt for maintaining the belt taut along its length as the pusher plate is moved across the stack of sheets.

25. An apparatus as claimed by claim 18 wherein the hold down traction means is comprised of a wheel rotatably mounted to the pusher plate and wherein the sheet engaging friction surface is situated on the wheel perimeter to tangentially engage the prescribed sheet in the stack immediately below a block of sheets engaged by the pusher plate;

wherein the driver link means is comprised of a linkage means connecting the wheel and the stacked sheet handling machine for rotating the wheel against the prescribed sheet in the stack, responsive to motion of the pusher plate; and further comprising hold down pressure means connected between the hold down traction means and the pusher plate for controlling the hold down traction means to exert a selected downward pressure against the prescribed sheet.

26. A sheet block handling machine, comprising:

a frame;

an elevator means for receiving a stack of sheets and for progressively moving the stack of sheets elevationally to present a top sheet of the stack at a preselected elevation;

a sheet block receiving means on a side of the frame adjacent the preselected elevation of the stack as positioned by the elevator means;

a sheet block pusher plate moveable substantially horizontally to engage a block of sheets along one side surface of the block and to move the engaged block of sheets across the sheet stack toward the sheet block receiving means;

hold down traction means mounted for movement with the pusher plate, said hold down traction means including a sheet engaging friction surface which engages a top surface of a prescribed sheet in the stack immediately below a block of sheets engaged by the pusher plate;

driver link means for driving the sheet engaging friction surface independently of contact with the top surface of the prescribed sheet in a direction opposite to that in which the pusher plate is moved to hold the prescribed sheet stationary relative to the stack of sheets.

27. An apparatus as claimed by claim 26 wherein the pusher plate is mounted to the frame for movement at a downward angle toward the stack from an elevated position adjacent the one side surface of the stack.

28. An apparatus as claimed by claim 26 further comprising hold down pressure means between the hold down traction means and the pusher plate for yieldably controlling downward force of the hold down traction means against the prescribed sheet.

29. An apparatus as claimed by claim 26 wherein the driver link means is operably connected to the stacked sheet handling machine to operate the hold down traction means to move the sheet engaging friction surface in a direction opposite to that in which the pusher plate is moved in response to movement of the pusher plate.

30. An apparatus as claimed by claim 26 wherein the hold down traction means is comprised of:

a guide on the pusher plate adjacent a bottom surface thereof;

an elongated friction belt having first and second ends attached to the stacked sheet handling machine, and a length dimension between the first and second ends;

wherein the elongated friction belt is trained along its length over the guide on the pusher plate; and take up means for maintaining the belt taut along its length as the pusher plate is moved across the stack of sheets.

31. An apparatus as claimed by claim 26 wherein the hold down traction means is comprised of a wheel rotatably mounted to the pusher plate and wherein the sheet engaging friction surface is situated on the wheel perimeter to tangentially engage the prescribed sheet in the stack immediately below a block of sheets engaged by the pusher plate.

* * * * *